United States Patent [19]

Amir

[11] Patent Number: 4,533,906

[45] Date of Patent: Aug. 6, 1985

[54] FENCE PARTICULARLY USEFUL FOR DETECTING INTRUSION ATTEMPTS

[75] Inventor: Yoel Amir, Moshav Omer, Israel

[73] Assignee: Beta Engineering & Development Ltd., Beer-Sheva, Israel

[21] Appl. No.: 418,583

[22] Filed: Sep. 15, 1982

[30] Foreign Application Priority Data

Nov. 2, 1981 [IT] Italy ..... 64190

[51] Int. Cl.[3] ..... G08B 13/12

[52] U.S. Cl. ..... 340/541; 340/666; 256/36; 200/61.93

[58] Field of Search ..... 340/541, 666, 668; D25/77; 256/60, 61, 36, 47, 32, 35

[56] References Cited

U.S. PATENT DOCUMENTS

| | | | |
|---|---|---|---|
| 2,192 | 9/1863 | Rowell | 256/36 |
| 230,925 | 8/1880 | Curry | 256/36 |
| 349,559 | 9/1886 | Bell | 256/36 |
| 520,217 | 5/1894 | Perkins | 256/36 |
| 591,760 | 10/1897 | Harden | 256/36 |
| 4,155,083 | 5/1979 | Slaats et al. | 340/541 X |
| 4,318,088 | 3/1982 | Hunter | 340/541 |
| 4,327,358 | 4/1982 | Karas | 340/541 |
| 4,367,459 | 1/1983 | Amir et al. | 340/541 |

FOREIGN PATENT DOCUMENTS

| | | | |
|---|---|---|---|
| 1099761 | 1/1968 | United Kingdom | 256/32 |

*Primary Examiner*—James L. Rowland
*Assistant Examiner*—Thomas J. Mullen, Jr.
*Attorney, Agent, or Firm*—Benjamin J. Barish

[57] ABSTRACT

A wire fence includes a plurality of wires tensioned at their opposite ends by ground-anchoring means each comprising a pair of vertical posts anchorable in the ground in spaced parallel relationship, and a diagonal post secured between the lower end of one vertical post and the upper end of the other, so that the diagonal post extends at an incline between the two vertical posts. The fence includes trip-wires secured to the diagonal post and freely movable in the longitudinal direction with respect to the vertical posts. The trip wires are connected to a detector which is actuated upon the disturbance of a trip wire.

10 Claims, 2 Drawing Figures

FENCE PARTICULARLY USEFUL FOR DETECTING INTRUSION ATTEMPTS

BACKGROUND OF THE INVENTION

The present invention relates to wire fences. The invention is particularly useful with respect to wire fences equipped with a detector for detecting intrusion attempts, and is therefore described below in connection with such fences.

Wire fences capable of detecting intrusion attempts are gaining widespread use for protecting restricted areas against intrusion. Such wire fences commonly include a plurality of trip-wires tensioned between ground-anchoring posts and connected to detectors actuated upon the disturbance of the trip-wires. In the conventional arrangement, the ground-anchoring posts are vertical posts to which the trip-wires are secured. In such arrangements, however, it is possible for an intruder to climb over the fence by stepping very close to the point of securement of the wires to the vertical post, such that substantially his complete weight is taken up by the post and very little by the trip-wires. Thus, the displacement, if any, of the trip-wires may not be sufficient to actuate the detectors. Another disadvantage is that these conventional arrangements provide the climber with substantially horizontal foot-engaging surfaces (i.e., the securement points of the horizontal wires to the vertical posts), and also good hand-gripping support (i.e., the tops of the vertical anchor posts), thereby making it easier to climb over the fence.

SUMMARY OF THE INVENTION

An object of the present invention is to provide a wire fence, and particularly an intrusion-detecting wire fence, which has advantages in the above respects.

According to a broad aspect of the present invention, there is provided a wire fence including a plurality of wires tensioned between ground-anchoring means at their opposite ends, characterized in that said ground-anchoring means comprises a pair of vertical posts anchorable in the ground in spaced parallel relationship, and a diagonal post secured between the lower end of one of said vertical posts and the upper end of the other of said vertical posts so as to extend at an incline therebetween with respect to the ground, said wires being secured to said diagonal post and being longitudinally freely movable with respect to said vertical posts.

It will be appreciated that the foregoing features, when incorporated into simple wire fences not equipped with trip-wire actuated detectors, still provide the advantages of increasing the difficulty of a climber in attempting to climb the fence, since he no longer has substantially horizontal foot-engaging surfaces nor good hand-gripping support when attempting to climb the fence.

However, the invention is most advantageously useful in connection with intrusion-detecting fences, wherein the trip-wires are connected to detector means actuated upon the disturbance of the trip-wires. Thus, when an intrusion is attempted by climbing a fence constructed in accordance with the foregoing features, the weight of the climber produces a greater displacement of the trip-wires secured to the diagonal post, thereby better assuring that the trip-wires will actuate the detector.

Preferably, the diagonal post is secured between the pair of vertical posts so as to extend at an angle of substantially 45° with respect to the ground, although this angle can be varied usually within the range of 30°–60°. The greater the angle, the less will be the displacement of the trip-wires in an intrusion attempt by climbing; but the smaller the angle, the greater will be the required length of the diagonal post.

Two preferred embodiments of the invention are described below, in both of which the vertical posts also include wire-guiding means for maintaining the wires in parallel spaced relationship while permitting their free longitudinal movement. In one embodiment, the wire-guiding means supports the wires in a single vertical plane, and in a second described embodiment, the wire-guiding means also includes an upper section for supporting the wires in an upper plane inclined towards the outwardly facing side of the fence. In the latter described embodiment, at least one of the vertical posts includes an upper extension to which the wires are secured, which upper extension is constituted of two sections pivotably connected to each other at their inner ends. Thus, if an intrusion is attempted by climbing while hand-gripping the outer end of the anchor post upper extension, that outer end will pivot to displace the wires secured thereto, and thereby will actuate the detector.

BRIEF DESCRIPTION OF THE DRAWINGS

Further features and advantages of the invention will be apparent from the description below.

The invention is herein described, by way of example only, with reference to the accompanying drawings, wherein.

DESCRIPTION OF PREFERRED EMBODIMENTS

Figure 1:
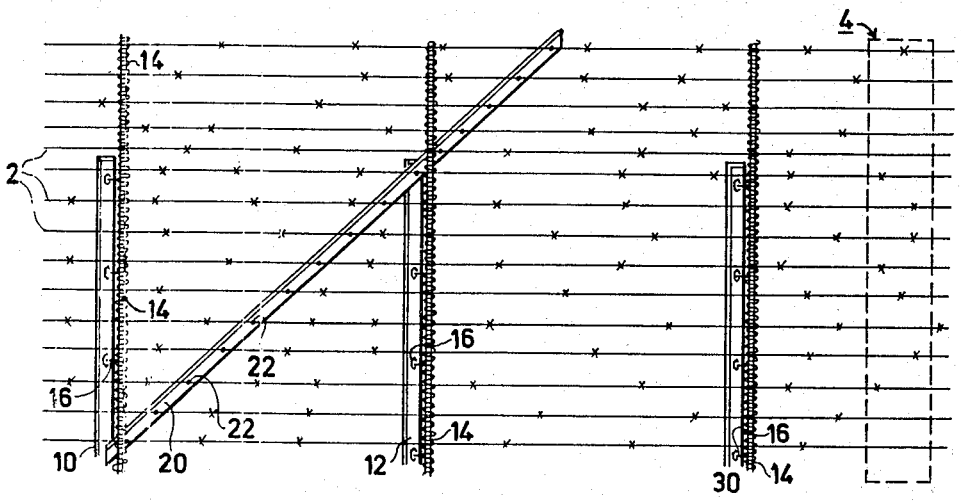
FIG. 1 illustrates a section of one form of wire fence constructed in accordance with the present invention.

The wire fence illustrated in FIG. 1 comprises a plurality of trip-wires 2 tensioned between ground-anchoring means at their opposite ends and connected to detector means actuated upon the disturbance of the trip-wires. FIG. 1 illustrates only one ground-anchoring means, as will be described more particularly below, and further illustrates the detector means schematically by the block 4. Such detector means may take any one of many known forms and may be connected in any one of many known manners to the trip-wires 2 so as to detect any displacement of the trip-wires caused by climbing over the fence, or by spreading the wires apart in order to penetrate through the fence.

The ground-anchoring means, in the fence illustrated in FIG. 1, comprises a pair of vertical posts 10, 12, anchorable in the ground in spaced parallel relationship. These posts support wire-guiding means, generally designated 14, which maintain the wires 2 in parallel spaced relationship, but permit their free longitudinal movement so as to enable them to actuate detector 4 in the event of an attempted intrusion. In the arrangement illustrated in FIG. 1, the wire-guiding means 14 is in the form of an open spiral rod attached to the vertical post 10 by a short rod or link 16 so as to support the spiral rod in a force-yielding manner laterally of the post, as described in our prior Pat. No. 54,708. Such an arrangement precludes disabling the detector merely by fastening the tensioned trip-wire to the spiral rod.

The ground-anchoring posts further include a diagonal post 20 secured between the lower end of vertical post 10 and the upper end of vertical post 12 so as to extend at an incline with respect to the ground. The trip-wires 2 are secured to the diagonal post 20, and not to the vertical posts 10, 12, or to their wire-guiding spiral rods 14. The trip-wires 2 may be secured, at points 22, to the diagonal post 20 in any suitable manner, for example by welding, or by the use of clips or fasteners.

The fence illustrated in FIG. 1 would also include one or more intermediate fence posts, such as illustrated at 30 in FIG. 1, each supporting a wire-guiding spiral rod 14 in a force-yielding manner so as to maintain the trip-wires in parallel spaced relationship while still permitting them to move longitudinally.

The fence illustrated in FIG. 1 is of one conventional type, wherein the wires 2 are supported substantially in a single plane. In such a fence, it is preferable that the wire-guiding spiral rods 14 extend above the vertical anchor posts 10, and also that the diagonal post 20, to which the wires 2 are secured, also extend above the vertical posts 10.

It will be appreciated that the fence illustrated in FIG. 1 will be much more difficult to climb over than the conventional type fence briefly mentioned above; and moreover, an intrusion will be much more likely to be detected by the detectors 4. Thus, if an intruder attempts to climb over the fence by stepping on the points of juncture between the diagonal anchor post 20 and the trip-wires 2, the intruder's weight will tend to bend the diagonal post 20, thereby producing a substantially greater displacement of the trip-wires 2 secured to the post than in the conventional type fence wherein the intruder may apply his weight so that it is substantially taken up by a vertical post. This greater displacement of the trip-wires 2 will be much more likely to be detected by the detectors 4 than in the conventional fence.

Moreover, in attempting to climb over the fence illustrated in FIG. 1, the intruder will be deprived of the substantially horizontal foot-engaging surfaces and vertical hand-gripping support for the climber provided by the conventional fences including vertical anchor posts, thereby making it more difficult for the intruder to penetrate the fence.

Figure 2:
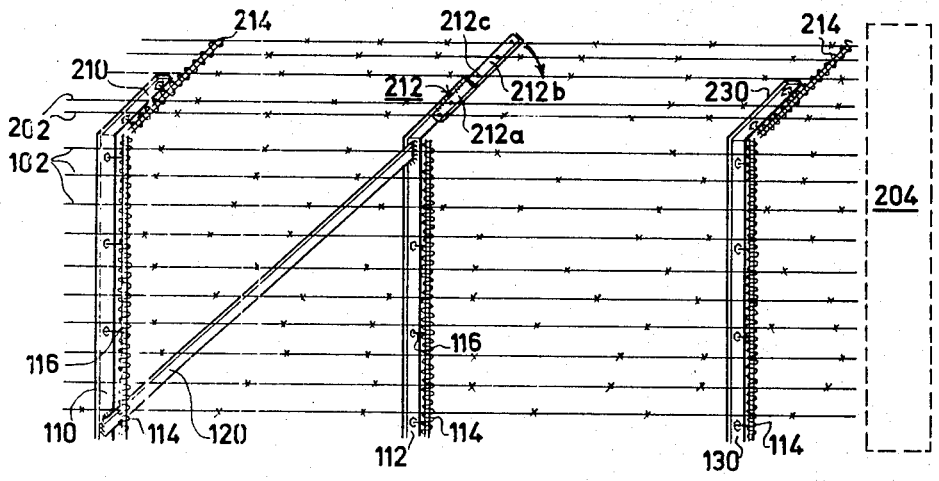
FIG. 2 illustrates a section of a second form of wire fence constructed in accordance with the present invention.

FIG. 2 illustrates another form of fence of the type including an upper section for supporting the wires in a plane inclined with respect to the vertical plane of the main fence section, the upper section of the fence being inclined towards the outwardly facing side of the fence so as to increase the difficulty presented to an attempted intruder. Thus, the main vertical section of the fence is constructed as described above with respect to FIG. 1, wherein the trip-wires 102 are secured to a diagonal anchor post 120, the latter being secured diagonally between two vertical anchor posts 110, 112. As in FIG. 1, the trip-wires 102 are maintained in parallel spaced relationship by a wire-guiding spiral rod 114 secured in a force-yielding manner by horizontal links or rods 116 laterally of each of the two vertical posts 110, 112.

As in the fence illustrated in FIG. 1, the fence illustrated in FIG. 2 also includes one or more intermediate vertical fence posts 130 each carrying, in a force-yielding manner, a wire-guiding open spiral rod 114 for maintaining the trip-wires 102 in parallel spaced relationship while still permitting them to move longitudinally to actuate the detector means, schematically illustrated at 204 in FIG. 2.

In the construction illustrated in FIG. 2, the diagonal posts 120, to which the wires 102 are secured, terminate at the upper end of the vertical section of the fence. The trip-wires in the upper inclined section of the fence, wherein they are designated 202, are supported in spaced, parallel and longitudinally-displaceable relationship by a wire-guiding spiral rod 214. The latter rod is secured in a force-yielding manner to inclined extensions 210 and 230 formed, respectively, at the upper ends of the vertical posts 110 and 130, but not of vertical post 112.

The upper end of vertical post 112, to which the upper end of the diagonal post 120 is secured, also includes an inclined extension 212. However, this inclined extension 212 does not include the wire-guiding spiral rod 214 through which the trip-wires pass; rather, the trip-wires 202 are secured to this inclined extension 212 at the upper end of the vertical anchor post 112 in the same manner as they are secured to the diagonal post 120 in the main fence section.

Inclined extension 212, however, is formed of two sections, namely an inner section **212*a* and an outer section 212*b*, which two sections are pivotably mounted at their confronting ends by a pin 212*c*. Thus, if an attempted intruder hand-grips the outer section 212*b* in order to support himself in an attempt to climb over the fence, that outer section will pivot with respect to the inner section 212*a*, so that the trip-wires 202 secured to the outer section will be displaced and will thereby actuate the detectors 204**.

While the invention has been described with respect to two preferred embodiments, it will be appreciated that many other variations, modifications and applications of the invention may be made.

What is claimed is:

1. A wire fence including a plurality of trip-wires tensioned between ground-anchoring means at their opposite ends and connected to detector means actuated upon the disturbance of the trip-wires, characterized in that said ground-anchoring means comprises a pair of anchoring posts anchorable in the ground in spaced parallel relationship, and a diagonal post secured to said anchoring posts so as to extend at an incline therebetween with respect to the ground, said trip-wires being secured to said diagonal post and being longitudinally freely movable with respect to said anchoring posts, thereby increasing the difficulty of one attempting to climb over the fence by depriving him of a substantially horizontal foot-engaging surface and a good hand-gripping support, the weight of one attempting to climb the fence producing a large displacement of the trip-wires secured to the diagonal post thereby better assuring that the trip-wires will actuate the detector.

2. The fence according to claim 1, wherein said diagonal post is secured between said pair of vertical posts so as to extend at an angle of 30°–60° with respect to the ground.

3. The fence according to claim 2, wherein said diagonal post is secured between said pair of vertical posts so as to extend at an angle of approximately 45° with respect to the ground.

4. The fence according to claim 1, wherein said vertical posts also include wire-guiding means for maintaining the wires in parallel spaced relationship while permitting their free longitudinal movement.

5. The fence according to claim 1, wherein said wire-guiding means supports the wires in a vertical plane and also includes an upper section for supporting the wires in an upper plane inclined towards the outwardly facing side of the fence, at least one of said vertical posts including an upper extension to which said wires are secured, said upper extension being constituted of two sections pivotably connected to each other at their inner ends.

6. The fence according to claim 5, wherein one of said vertical posts includes said two-section extension to which the wires are secured, and the other of said vertical posts includes said wire-guiding means for maintaining the wires in said upper section in parallel spaced relationship while permitting their free longitudinal movement.

7. A wire fence including a plurality of trip-wires tensioned between ground-anchoring means and connected to a detector for actuating same, characterized in that said ground-anchoring means comprises a pair of vertical posts anchorable in the ground in said spaced parallel relationship, and a diagonal post secured between the lower end of one of said vertical posts and the upper end of the other of said vertical posts so as to extend at an incline therebetween with respect to the ground, said wires being secured to said diagonal post and being longitudinally freely movable with respect to said vertical posts thereby increasing the difficulty of one attempting to climb over the fence by depriving him of a substantially horizontal foot-engageing surface and a good hand-gripping support; the weight of one attempting to climb the fence producing a large displacement of the trip-wires secured to the diagonal post, thereby better assuring that the trip-wires will actuate the detector.

8. The fence according to claim 7, wherein said vertical posts also include wire-guiding means for maintaining the trip-wires in parallel spaced relationship while permitting their free longitudinal movement.

9. The fence according to claim 7, wherein said wire-guiding means supports the trip-wires in a vertical plane and also includes an upper section for supporting the trip-wires in an upper plane inclined towards the outwardly facing side of the fence, at least one of said vertical posts including an upper extension to which said trip-wires are secured, said upper extension being constituted of two sections pivotably connected to each other at their inner ends.

10. The fence according to claim 9, wherein one of said vertical posts includes said two-section extension to which the trip-wires are secured, and the other of said vertical posts includes said wire-guiding means for maintaining the trip-wires in said upper section in parallel spaced relationship while permitting their free longitudinal movement.

* * * * *